US007331838B2

(12) United States Patent
Shantz

(10) Patent No.: US 7,331,838 B2
(45) Date of Patent: Feb. 19, 2008

(54) PROPELLER IMPACT PROTECTOR AND MODEL FLYING AIRPLANE INCORPORATING SAME

(75) Inventor: Michael Shantz, Cupertino, CA (US)

(73) Assignee: Jasman Asia Ltd., Kowloon (HK)

( * ) Notice: Subject to any disclaimer, the term of this patent is extended or adjusted under 35 U.S.C. 154(b) by 117 days.

(21) Appl. No.: 10/825,214

(22) Filed: Apr. 16, 2004

(65) Prior Publication Data

US 2005/0233672 A1 Oct. 20, 2005

(51) Int. Cl.
*A63H 27/22* (2006.01)

(52) U.S. Cl. ..... 446/57

(58) Field of Classification Search ..... 446/34, 446/57, 58, 59, 60
See application file for complete search history.

(56) References Cited

U.S. PATENT DOCUMENTS

| | | | | |
|---|---|---|---|---|
| 990,897 | A | 5/1911 | Newbury | |
| D169,558 | S | 5/1953 | Nagler | |
| 2,949,693 | A | 8/1960 | McRoskey | |
| 3,388,651 | A * | 6/1968 | Axelrod | 446/34 |
| 3,742,643 | A | 7/1973 | Kelth | |
| 3,787,997 | A * | 1/1974 | Lemelson | 446/60 |
| 3,796,005 | A | 3/1974 | Chang et al. | |
| 3,937,424 | A * | 2/1976 | Meier et al. | 244/53 R |
| 3,955,817 | A | 5/1976 | Davis | |
| 3,985,322 | A * | 10/1976 | Mabuchi et al. | 248/554 |
| 4,161,843 | A | 7/1979 | Hui | |
| 4,337,950 | A | 7/1982 | Gidge | |
| 4,591,164 | A | 5/1986 | Blight | |
| 5,030,157 | A | 7/1991 | Silverglate | |
| 5,297,759 | A | 3/1994 | Tilbor et al. | |
| 5,505,407 | A | 4/1996 | Chiappetta | |
| 5,634,839 | A | 6/1997 | Dixon | |
| 5,672,086 | A | 9/1997 | Dixon | |
| D395,683 | S | 6/1998 | Chiappetta | |
| 6,086,016 | A | 7/2000 | Meek | |
| 6,550,715 | B1 | 4/2003 | Reynolds et al. | |
| 6,568,980 | B2 * | 5/2003 | Barthold | 446/36 |
| 6,659,395 | B2 | 12/2003 | Rehkemper et al. | |
| 2002/0106961 | A1 | 8/2002 | Barthold | |
| 2002/0142699 | A1 | 10/2002 | Davis | |
| 2003/0096553 | A1 | 5/2003 | Kim et al. | |

FOREIGN PATENT DOCUMENTS

| | | |
|---|---|---|
| GB | 2 091 571 A | 8/1982 |
| WO | WO 01/03790 A1 | 1/2001 |

OTHER PUBLICATIONS

Nicoud, Jean D., et al. "Toward Indoor Flying Robots." pp. 1-6.

(Continued)

*Primary Examiner*—John A. Ricci
(74) *Attorney, Agent, or Firm*—McDermott Will & Emery LLP

(57) ABSTRACT

An airplane flying toy includes a longitudinal frame bearing a wing and a stabilizer, a propeller rotatably disposed at an end of the frame, a force generating device attached to the longitudinal frame and adapted to impart a rotary motion to the propeller by a rotatable shaft, and a propeller protector extending at least partially around and longitudinally beyond the propeller, the propeller connector being connected by struts to the longitudinal frame.

18 Claims, 7 Drawing Sheets

OTHER PUBLICATIONS

Zufferey, J.C., et al. "Adaptive Vision-based Flying Robots." pp. 1-8 URL: http://asl.epfl.ch/research/projects/AdaptiveVisionbasedFlyingRobots/index.php.

"Le Moins que Rien: Monoplan Indoor de 8,9 grammes." pp. 3 total URL: http://jmquetin.free.fr/jmpmolnf.htm.

"Print-outs from DiDel.comwebsite." pp. 27 total.

* cited by examiner

PROPELLER IMPACT PROTECTOR AND MODEL FLYING AIRPLANE INCORPORATING SAME

TECHNICAL FIELD

The present disclosure relates to a protective structure for a propeller used in indoor flying toys, ultra-light flying toys, and lighter-than-air flying toys including, but not limited to a propeller used in model flying airplanes, particularly those of the "slow flyer" variety.

BACKGROUND

The popularity of indoor flying toys, particularly ultra-light slow flying airplanes and self-propelled lighter-than-air flying toys (LTAs) (e.g., miniature balloons or blimps), is increasing. Indoor airplanes, such as shown in FIGS. 1(*a*)-1(*c*) comprise a single wing 50 and tail structure 55 are disposed on a frame 60. A drive system including a propeller 10, a motor 15 and associated power source 20 (e.g., a battery or other charge storing device) or other power providing device (e.g., a rubber band, compressed gas) is provided to impart rotation to the propeller via a drive shaft. Indoor airplanes electric motors are conventionally powered by lithium-ion or nickel-metal-hydride (NiMH) batteries and, more recently, lithium-polymer (LiPo) batteries. A receiver 25 may be optionally provided in combination with a speed control device and/or actuating device(s) 30 (e.g., electromagnetic coils) to permit actuation of controls or control surfaces (e.g., the rudder or stabilizer) to change flight characteristics during flight. Power systems and controls (e.g., a 3-channel control for rudder, throttle, and elevator) may also combined with indoor LTAs.

Indoor flight of such airplanes and lighter-than-air flying toys broadly includes any enclosed area such as an armory, auditorium, school gymnasiums, convention centers, or the like. Historically, given the speed and size of the indoor aircraft, large spaces were required to accommodate the flight characteristics of the indoor aircraft. For example, indoor micro-RC (radio controlled) or scale-RC model airplanes having specified minimum wing areas (e.g., greater than 135 in.$^2$), power plants (e.g., GWS IPS DXA 5.86-1 motor/gear unit), propellers, batteries (e.g., 2 lithium-poly cells or 6 nickel-cadmium or nickel-metal-hydride cells), and weights (e.g., between about 7-8 ounces) are typically flown in relatively large indoor areas (e.g., school gymnasiums) in pylon racing competitions sponsored by NIRAC (National Indoor Remote Control Aeromodeling Council). The specifications for a particular competition may vary. NIRAC also sponsors indoor RC scale events wherein models are powered by electric, $CO_2$, compressed air, or rubber bands, the models cannot weigh more than 12 ounces, and the models must have a maximum wing loading not to exceed 6 ounces per square foot.

Over time, advances in power plants and materials have permitted smaller and slower airplanes to fly within smaller and smaller areas, thus taking indoor flight out of the province of the professional modeler or skilled hobbyist and into the realm of the general public. Presently, slow flying airplanes are provided to fly within small enclosed areas (e.g., a 10'×10' room), such as rooms within houses or living quarters. Conventional slow flying airplanes include the Ikara "Firefly" Indoor Airplane, a rubber-powered free-flight glider from Hobby-Lobby International Inc. of Brentwood, Tenn. USA. The "Firefly" has a wingspan of about 7" and an RTF of about 2.7 grams (0.10 oz.) and is capable of flight in a circle of about 10' diameter for 45 seconds to 2 minutes, depending on the configuration. A similar indoor plane, called the "Kolibri", has a wingspan of 8.5" and a weight of 3 grams. Other indoor ultra-light slow-fly models include the "Celine" sold as a kit by Didel of Belmont/Lausanne, Switzerland, and shown in FIGS. 1(*a*)-1(*c*). These ultra-light slow-fly models generally fly at speeds of between about 1.0-1.5 m/s and are constructed from conventional light-weight parts such as, but certainly not limited to, Didel 4 mm coreless motors, gear boxes, bird (built-in-rudder-device) actuators, and IR receivers.

Improvements to indoor planes typically focus on decreasing the overall weight of the aircraft to improve the power to weight ratio or lift to drag ratio and the flight time of the airplane. However, structural integrity of the plane or airship, particularly of the propeller and the propeller-to-frame connection, is often overlooked. Accordingly, a need exists for a lightweight structure for protecting the propeller(s) of indoor flying toys, such as but not limited to the aforementioned types of indoor flying toys.

SUMMARY

An aspect of the present disclosure presents an airplane flying toy comprising a longitudinal frame bearing a wing and a stabilizer, a propeller rotatably disposed at an end of the frame, a force generating device attached to the longitudinal frame and adapted to impart a rotary motion to the propeller by a rotatable shaft, and a propeller protector extending at least partially around and longitudinally beyond the propeller, the propeller connector being connected by struts to the longitudinal frame.

In another aspect, an ultra-light slow flying toy airplane is provided comprising a frame and a battery-powered motor attached to the frame, wherein the motor is configured to rotate a propeller. The frame comprises a main longitudinal element comprising a longitudinal rod, a wing support structure, and a propeller protector structure. The wing support structure comprises a vertical wing fore strut, a horizontal wing fore strut, a plurality of wing rear struts, and a plurality of chordal struts collectively securing a wing to the main longitudinal element. The propeller protector structure comprises at least one rod disposed to extend at least partially around and longitudinally beyond the propeller. The propeller connector is connected to the wing support structure and/or the main longitudinal element by a plurality of struts.

These aspects of the disclosure together with additional features and advantages thereof may best be understood by reference to the following detailed descriptions and examples taken in connection with the accompanying illustrated drawings.

BRIEF DESCRIPTION OF THE DRAWINGS

Like reference characters designate identical or corresponding components and units throughout the several views. The drawings and accompanying description are illustrative in nature and are not restrictive to the broader aspects of the present concepts disclosed herein.

DETAILED DESCRIPTION

Figure 1A:
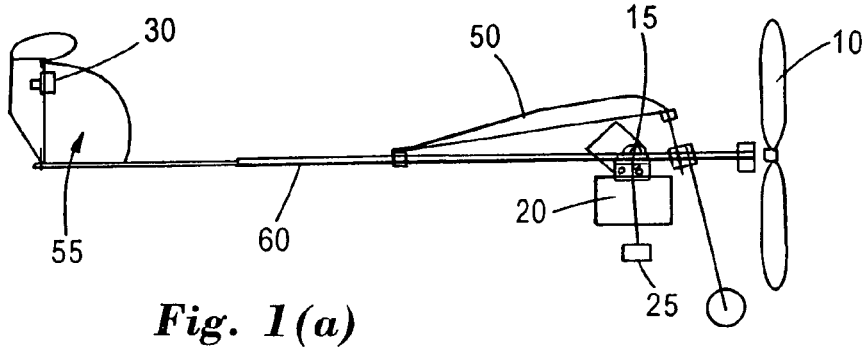
Fig. 1(a) (PRIOR ART)
FIGS. 1(*a*)-1(*c*) are side, top, and front views of a conventional ultra-light slow flyer indoor airplane.
Figure 1B:
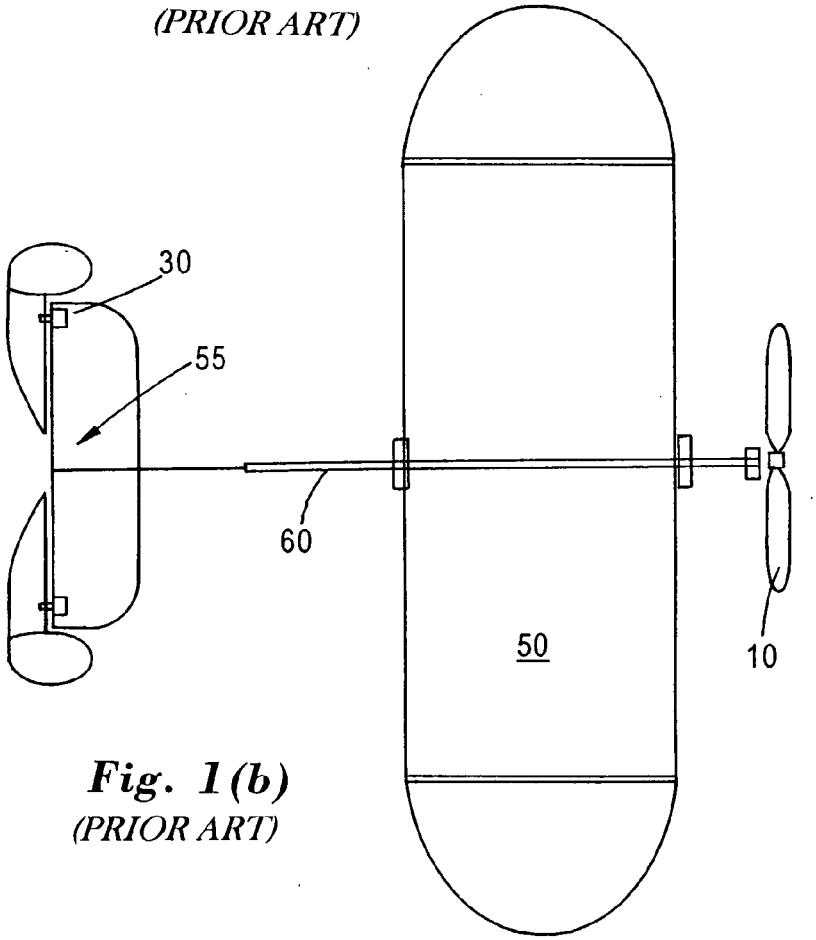
Fig. 1(b) (PRIOR ART)
Figure 1C:
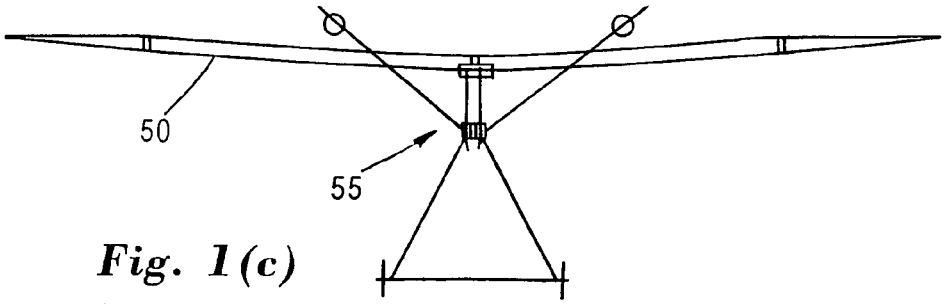
Fig. 1(c) (PRIOR ART)
Figure 2:
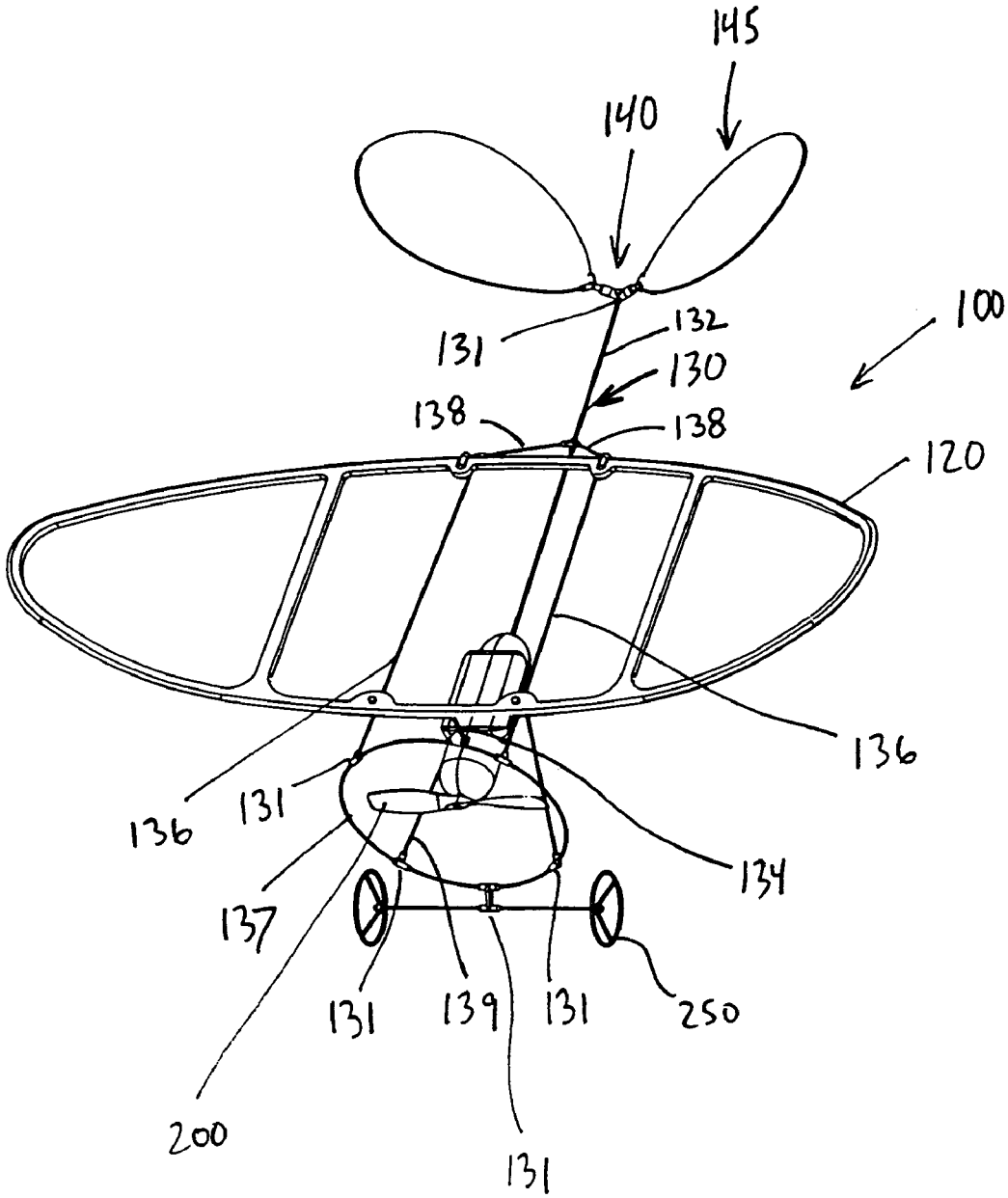
FIG. 2 is an isometric view of an example of an indoor airplane including a propeller impact protector in accord with the present disclosure.
Figure 3:
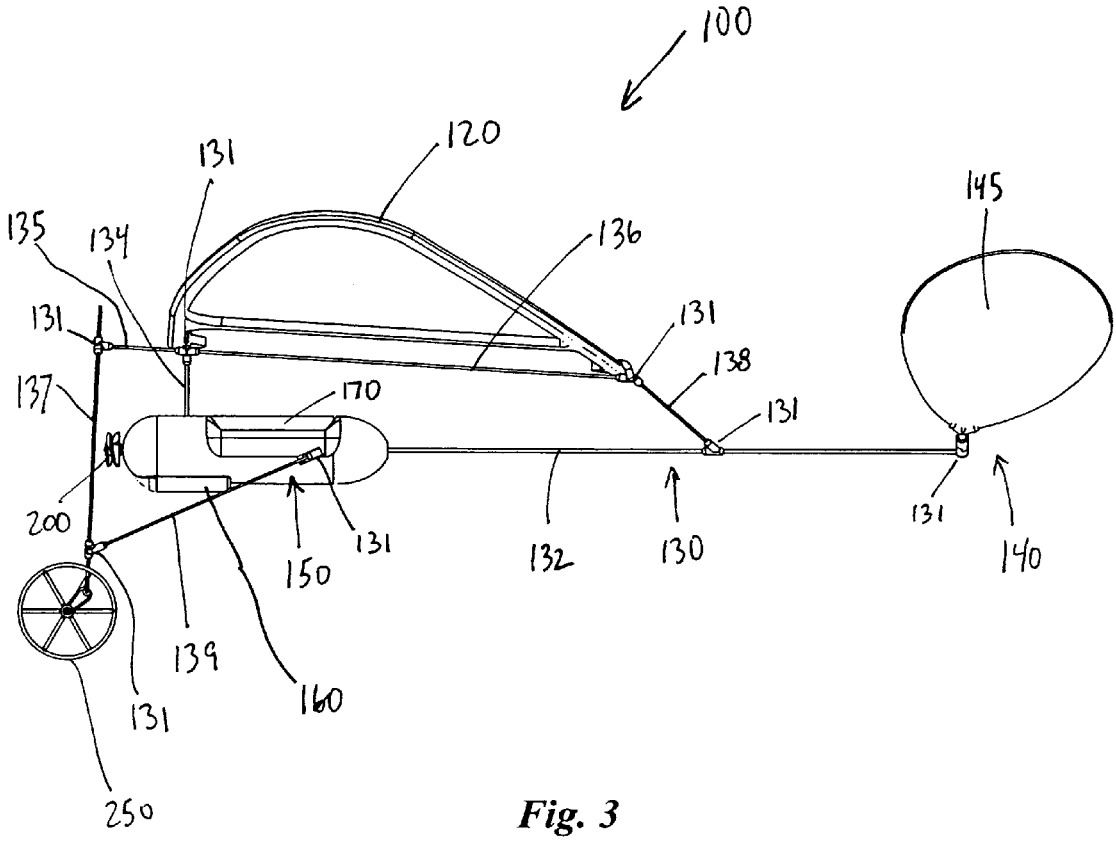
FIG. 3 is a side view of the indoor airplane shown in FIG. 2 including a propeller impact protector in accord with the present disclosure.
Figure 4A:
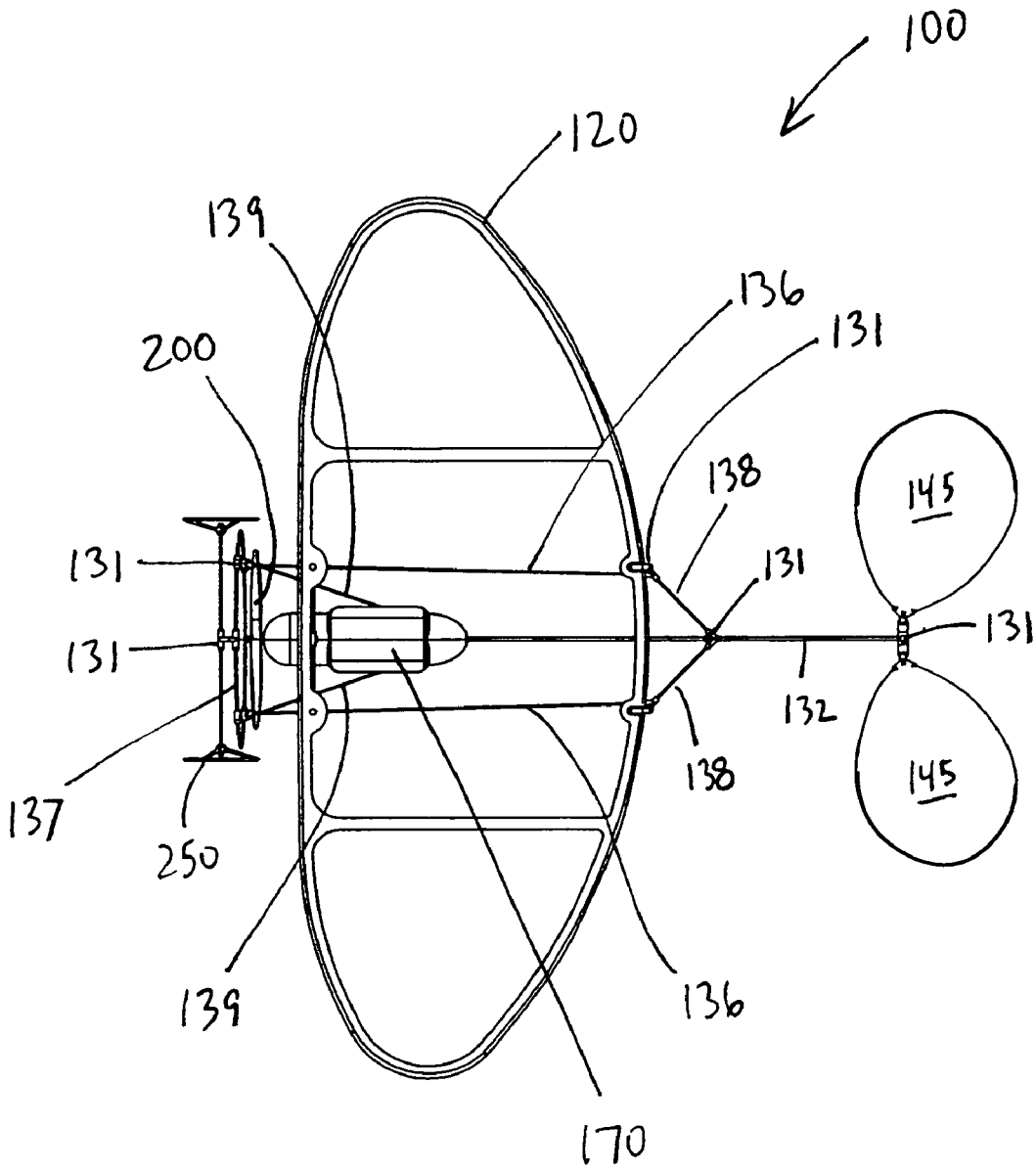
FIGS. 4(*a*)-4(*b*) are top and bottom views of the indoor airplane shown in FIG. 2 including a propeller impact protector in accord with the present disclosure.
Figure 4B:
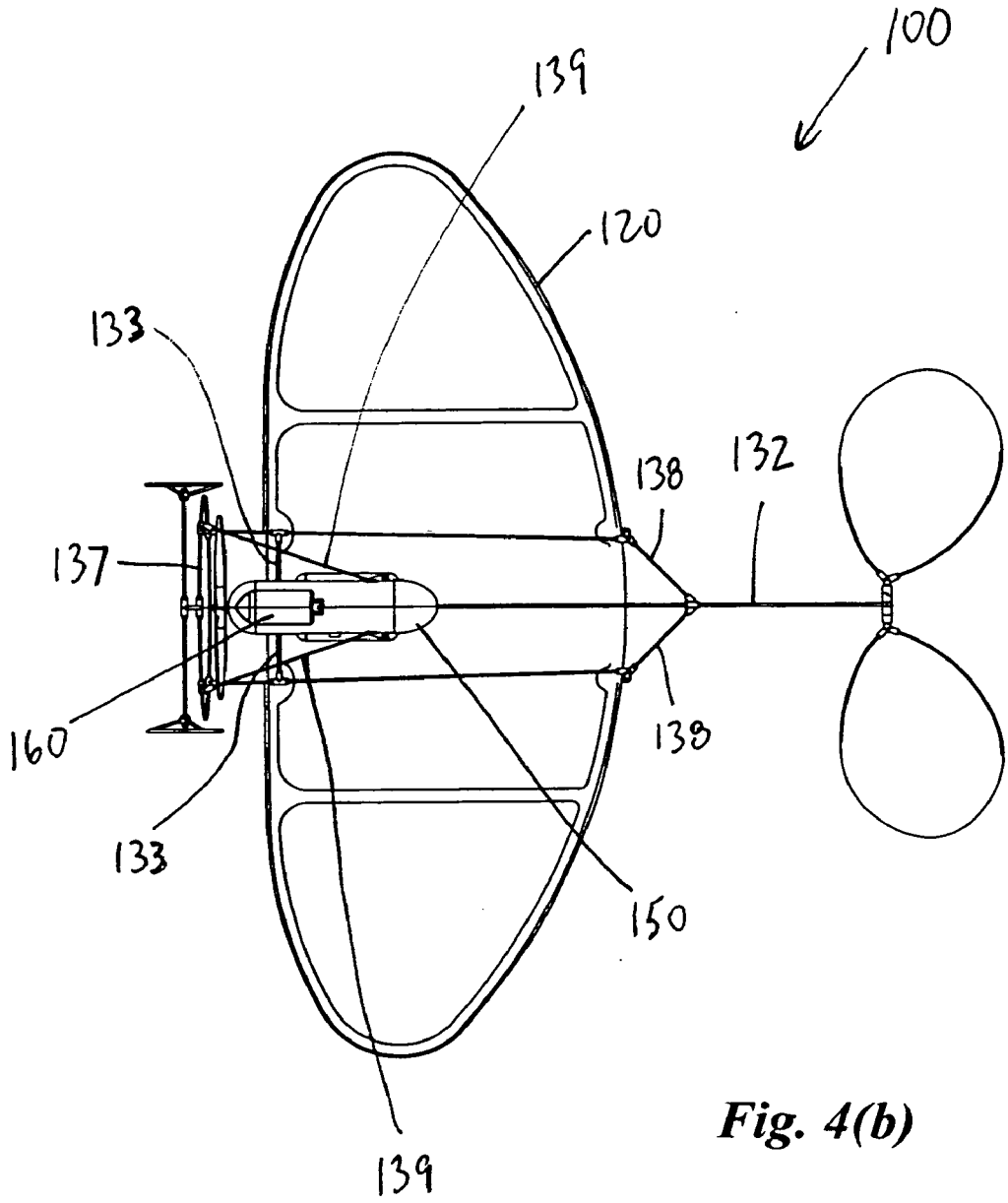
Figure 5A:
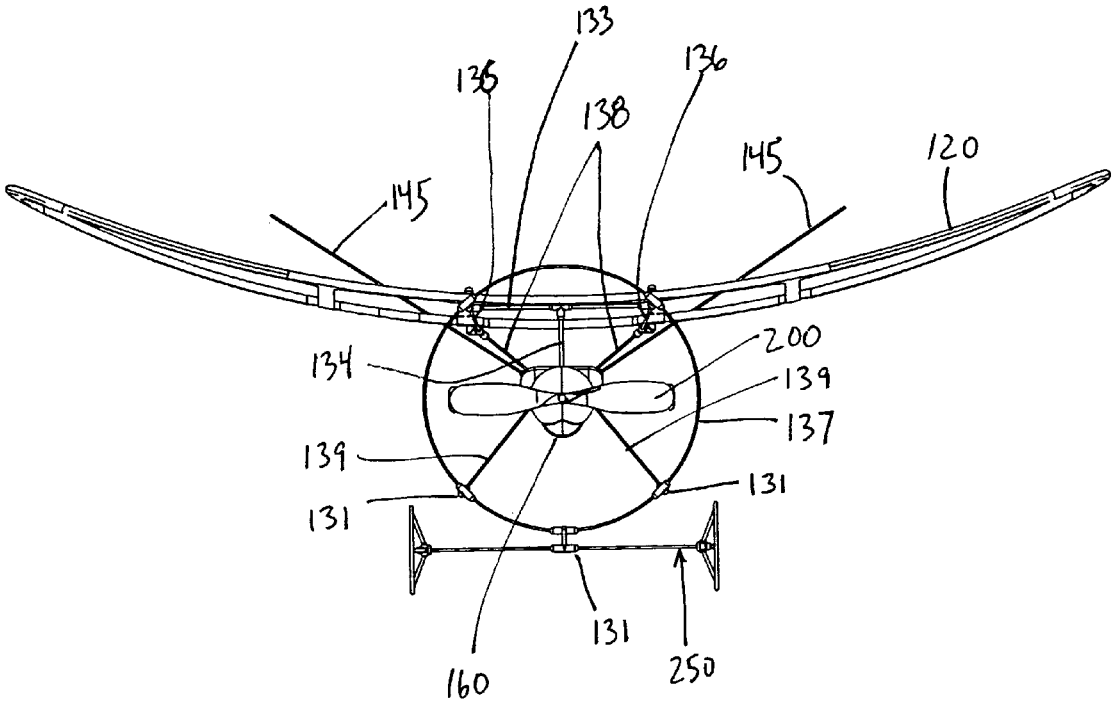
FIGS. 5(*a*)-5(*b*) are front and rear views of the indoor airplane shown in FIG. 2 including a propeller impact protector in accord with the present disclosure.
Figure 5B:
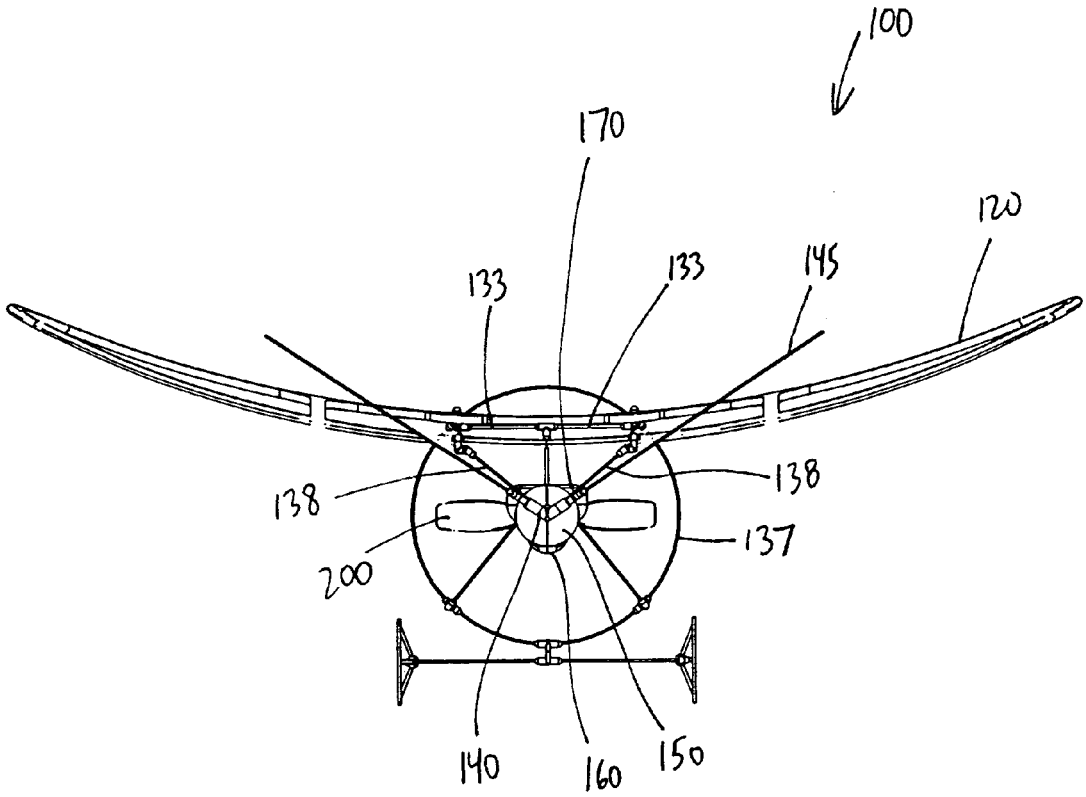

Referring to FIGS. 2-5(*b*), an exemplary embodiment of an indoor airplane in accord with the present disclosure is shown. As shown in the example of FIG. 2, the indoor airplane 100 generally includes a single wing 120 or a corresponding left and right wing disposed above, below, or to the frame or fuselage 130. The wing 120 may be dihedral with respect to the local horizontal, as shown in FIGS. 2 and 5(*a*)-5(*b*), for roll stability. The wing 120 may alternatively be anhedral to provide a higher roll rate. Any conventional wing planform may be used (e.g., rectangular straight wing, tapered straight wing, rounded or elliptical straight wing, swept wing) in any wing configuration (e.g., fully cantilevered wing, semi-cantilevered wing, externally braced wing, bi-plane, or tri-plane). At a rear portion of the frame 130, the empennage or tail structure 140 includes a stabilizer structure 145 comprising a v-butterfly tail. However, other conventional stabilizer structures 145 may be used including, but not limited to, a T-tail with vertical and horizontal stabilizers, a twin tail (a horizontal stabilizer with a right and left vertical fin), a canted vertical tail with or without separate horizontal stabilizers, or a dorsal/ventral fin combination.

Although no control surfaces are shown in the illustrated example, it is to be understood that adjustable control surfaces may be used in accord with the presently disclosed concepts. Adjustable control surfaces may include any combination of rudders (to change yaw), elevators (to change pitch), flaps (to change lift/drag), aileron (to change roll), spoilers (to change lift/drag), or slats (to change lift). In simple applications, the control surfaces may be pre-set to a substantially fixed configuration prior to flight, such as to achieve a circular, curved, and/or level flight path. More complex applications may include one or more controls (e.g., throttle) or control surfaces adapted for in-flight control by means of a conventional lightweight radio-controlled (RC) or infrared (IR) receiver (e.g., a TED3 or TED4 Infrared (IR) transmitter or radio-controlled (RC) transmitter), an associated transmitter, and on-board actuator(s) (e.g., a MIR3 to MIR6 controller or other conventional magnetic actuator). The MIR3 and MIR 4 controllers, for example, are specially configured for use with ultra-light slow flyers using single-cell Li-poly batteries and can control one propeller motor and two or three low power actuators.

In various aspects, an indoor airplane in accord with the presently disclosed concepts could be configured to permit control of the engine or of a rudder, an elevator, and/or ailerons in the V-tail. Applications seeking to minimize weight, complexity, and/or cost may omit adjustable control surfaces entirely. In the illustrated example of an ultra-light slow flying indoor airplane 100, the tail stabilizers 145 are fixed (i.e., no in-flight adjustable control surfaces) and the motor (not shown) and propeller 200 shaft are at least substantially in-line with the main member 132 of frame 130. The motor torque and tail trim are configured to impart a high turning radius (e.g., about a 6-8 ft. turning radius) and lift at high throttle and to impart substantially straight flight when the throttle is eased back into a low throttle position. For example, from a standing start on the floor, the plane 100 takes off and flies in a tight upward spiral of about a 6 to 8 ft diameter. When the throttle is eased back, the motor torque is lessened and the plane flies in a substantially straight line. When the throttle is eased back even more, the plane descends in a substantially straight path. Thus, the flight of the plane 100 can be reliably controlled with one hand simply by adjustment of the throttle, which may be accomplished, in one aspect, by a transmitter with a thumb control level or track ball.

The frame or fuselage 130 may comprise any conventional lightweight material suitable for use with indoor flying toys. Light-weight and high strength materials are conventionally used in indoor ultra-light flying toys and typically include materials such as, but not limited to, carbon, lightweight wood (e.g., balsa), plastics, polymers, composites, or combinations thereof, which are also suitable for the presently disclosed indoor ultra-light flying toy. The frame 130 comprises, in one aspect, a main member 132 formed as a single carbon fiber. A tail structure 140 is mounted toward or on the rear end of the main member 132 using a connecting member 131, which may comprise a plastic (e.g., polycarbonate) joint, configured to permit attachment/removal of the tail structure 140 from the main member and/or to permit attachment/removal of individual stabilizers 145 from the tail structure.

Frame 130 also comprises additional members including, but not limited to, a horizontal wing fore strut 133, a vertical wing fore strut 134, wing rear struts 138, longitudinally extending chordal struts 136, propeller protector 137, upper connecting struts 135, and lower connecting struts 139. Wing rear struts 138 may connect to frame 130 at any point, preferably behind the wing. Wing rear struts 138 may also be connected to a rear end of main member 132. Frame 130 may comprise separate forward connecting struts 135 and longitudinally extending chordal struts 136 or a single unitary strut extending from the propeller protector 137 to a rearward portion of the wing 120 or frame 130. In the illustrated examples, the aforementioned frame members are connected to adjoining frame members, as shown, using connecting members 131. A landing gear structure 250, which may comprise wheels joined by an axle, is disposed at a forward and bottom portion of the frame and is connected, in one aspect, to propeller protector 137 by a connecting member 131. Vertical wing fore strut 134, horizontal wing fore strut 133, wing rear struts 138, and longitudinally extending chordal struts 136 are also removably connected to respective portions of the wing 120 by conventional connection members, such as snap-fit connectors, to secure the wing to the frame 130. Lower connecting struts 139 connect the propeller protector 137 to the main member 132 through the motor housing 150, such as shown in FIG. 3, using a connecting member 131.

The propeller protector 137 is disposed forward of the propeller 200 to protect the propeller from inadvertent contact with external objects and/or to protect persons, objects, and/or animals from inadvertent contact with the propeller. The frame 130, including the propeller protector 137, is designed to absorb heavy impacts on the propeller protector and to disperse these impact forces along the entire air frame structure. This dispersal of forces is facilitated by the connection of the propeller protector 137, via struts 135, 136, 138, and 139 to, at a distal end, the backbone or main element 132 of frame 130.

In the illustrated example, the propeller protector 137 is a carbon fiber rod that is bent or otherwise formed into a circular shape and joined to the rest of the frame 130 by connection members 131 and straight carbon fiber rods 135, 139. The propeller protector 137 may also comprise a plurality of sections, arranged in any geometric shape (e.g., square, pentagon, hexagon, octagon).

Propeller protector 137 may additionally comprise concentric sections (e.g., multiple circular rings) in a two or three dimensional arrangement. Cross-members may also be provided to span a distance between a first point on the propeller protector 137 and a second point on the propeller protector (e.g., a chord of the circle or a diameter of the circle) to provide additional protection to the propeller or to objects external to the propeller. The displacement of the propeller protector 137 relative to the propeller may also be increased or decreased in accord with the stiffness of the frame 130 members. For example, a stiffer frame would permit less deflection or compression of the frame members and would correspondingly require less offset of propeller protector 137 from the propeller 200 than would a less stiff frame.

In alternative embodiments, variations of the aforementioned propeller protector 137 may also be implemented. For example, the propeller protector 137 may be discontinuous with one or more struts (e.g., 135, 139) bearing, at front ends thereof, impact absorbing members (e.g., carbon tube segments or resilient foam members). In other aspects, a left upper connecting strut 135 may be connected to a right lower connecting strut 139 or landing gear structure 250 component with a strong, lightweight filament, which may optionally be placed under tension sufficient to prevent flexure of the filament into contact with propeller 200. Similarly, a right upper connecting strut 135 may be connected to a left lower connecting strut 139 or landing gear structure 250 component with another strong, lightweight filament, optionally placed under tension to form an "X" shaped barrier in front of propeller 200. Additional filaments may optionally be strung from the left upper connecting strut 135 to the left lower connecting strut 139 and from the right upper connecting strut 135 to the right lower connecting strut 139. In another aspect, a filament may be strung to form a box shape joining the upper connecting struts 135 to the lower connecting struts 139. Thus, propeller protector 137 may comprise a flexible (non-tensioned), slightly taught (slightly tensioned), or taught (tensioned) webbing. The filaments may be carbon filaments or other lightweight, strong material including, but not limited to metals, polymers (homopolymers or copolymers (e.g., Nylon 66)), fluoropolymers, polyethylene, natural or man-made silk (e.g., BioSteel®). The aforementioned embodiments of propeller protectors illustrate a few of the multiplicity of propeller protector designs in accord with the present concepts and demonstrates that lightweight propeller protectors in accord with the present concepts may comprise any shape or configuration. Further, such propeller protectors may utilize any lightweight material able to fully absorb or otherwise channel forces (either fully, substantially, or in part) away from the propeller.

Though the airplane of the illustrated example is light and the power and torque of the propeller are extremely slight, the propeller blade is continuously exposed to obstacles. In accord with the present disclosure and illustrated example, a propeller protector 137 is provided to absorb impact forces imparted thereto and transmit or disperse the same to the airplane frame 130 rather than to propeller 200.

In the illustrated example, the main member 132 of frame 130 comprises light-weight or ultra-light weight carbon fiber tube having a diameter of between about 0.8 mm to about 1.2 mm, a length of about 10-11", and a weight of about 0.45 grams. The aforementioned frame 130 components may comprise solid or hollow members of any geometrical cross-section (e.g., square, circular, oval, hexagonal, rectangular, triangular, I-beam, etc.) and may be formed by any conventional manufacturing process such as, but not limited to, pultrusion, extrusion, injection molding, or die forming.

A motor housing 150 is mounted toward or on the forward end of the main member 132. In one aspect, the motor housing 150 is a substantially cylindrical framework, lattice, or cage of carbon (or other material) structural members and the main member 132 may be connected thereto by means of a plastic connecting member 131. Other components, such as an RC receiver 160 and a battery 170 may also be attached thereto or housed at least partially within the motor housing 150, such as shown in FIGS. 3, 4(*a*), and 4(*b*). In another aspect, the motor housing 150 is an expanded polystyrene (EPS) foam formed into an aerodynamically shaped capsule (e.g., a substantially cylindrical body with rounded ends) having a longitudinal aperture formed in one end (i.e., a rear end) to permit insertion and securement of the main member 132.

The motor (not shown) may comprise a brushless or coreless DC motor, with the coreless DC motor being preferred for slow fly embodiments of the airplane. In one aspect thereof, the motor for the illustrated example of a slow fly airplane is a coreless DC motor operating between about 3.2 to 4.5 volts DC with an engine speed of about 30,000 rpm under no load conditions. Take off load from a standing start draws about 600 mah of current. Power may be provided from a lithium-polymer cell providing roughly 145 milliamps of current (e.g., a Powerflite SYE-301P (3.5 g) manufactured by Skybome Electronics of Garland, Tex., a Kokham LP145 LiPo cell (3.6 g), or other conventional LiPo, Ni—Cd or NiMH cell(s)). The motor, power source, and power transmission (e.g., reduction gears) are selected in accord with conventional design parameters for a given model type and application.

Motor housing 150 also includes a longitudinal aperture formed in another end (i.e., a front end) to provide a passage for the propeller drive shaft, which is typically, although not necessarily, a different shaft than the motor output shaft. The propeller 200 is mounted on the opposite end of the propeller drive shaft, which in one aspect is a 0.8 mm diameter carbon fiber having a length of 80 mm. In one aspect, propeller 200 comprises a conventional light-weight material such as carbon, plastic, balsa wood, or combinations thereof. The diameter and pitch of the propeller 200 may be determined in accord with a designed torque and power in view of a selected engine and reduction gear set. In the illustrated example, the diameter of the propeller 200 is 80 mm and the propeller comprises a polycarbonate plastic. In accord with the presently disclosed propeller protector 137, other propeller 200 design considerations, such as rigidity are less significant than for planes without such propeller protector.

The wing 120 structure including the ribs 121 and optional spars (not shown) may be formed by taking expanded polystyrene sheet (EPS) and then heat forming it to provide aerodynamic shape. The formed sheet is then cored to create a cookie cutter type framework to which DuPont® Mylar® is affixed, such as by lamination or bonding. The Mylar® EPS sheet is then cut (e.g., die cut) to create an ultra-light Mylar® wing on a thin EPS frame work. The EPS support material may, for example, have a thickness of about 2.0 mm to 8 mm and a density range of about 120 g/m$^2$ to about 280 g/m$^2$ (at 2.0 mm thickness). An EPS support material of 4.0 mm thickness is used in the present example.

In one aspect, the wing 120 may be formed in accord with the process described in the patent application titled "Light Weight Airfoil and Method of Manufacturing Same", filed contemporaneously as U.S. patent application Ser. No. 10/825,218 on behalf of Jasman Asia Ltd., and which is hereby incorporated by reference in its entirety. In an ultra-light slow flyer model, the wing 120 skin may advantageously a 6-micron (e.g., a 0.00025" thickness) or a 4-gauge (e.g., about a 0.000035" thickness) Mylar®. In the disclosed example, the wing 120 skin is a 6-micron Mylar. However, thicker skin materials (e.g., about a 50-micron Mylar) may be advantageously utilized for larger airfoils. By way of example, with an airfoil measuring about 16" from tip to tip and about 6" from leading edge to trailing edge, the airfoil has an area of about 90 in$^2$ and a weight of about 2.8 grams. These measurements yield an area to weight ratio of about 32 in$^2$/gram.

In other aspects, airplanes or lighter than air toys in accord with the present concepts may utilize a wing 120 skin of any conventional material (e.g., polyester tissue, silk, paper, biaxial oriented polypropylene (BOPP), and ethylene vinyl acetate (EVA)) and wing structure of any conventional lightweight structural material (e.g., balsa, plastic, polycarbonate, aerogels, composites, carbon-reinforced composites).

The herein disclosed indoor plane is built for in-the-house flying. It is made of exceptionally light and strong components to make it as light as possible so as to enable super slow, controllable flight (generally less than about 1.5 m/s) in confined spaces. The indoor plane 100 in accord with the present concepts depicted by way of example in FIGS. 2-5(*b*) weighs between about 16.0-17.0 grams (a little over half an ounce) and has a 16" wing span. Moreover, the propeller protector disclosed herein enables transmission of any impact forces of the airplane to a central portion of the airplane frame.

Additional features of the present disclosure will become readily apparent to those skilled in the art from the following detailed description, wherein only aspects of the disclosure are shown and described, simply by way of illustration of the best mode presently known and contemplated for carrying out the disclosure. As will be realized, the disclosure is capable of other and different embodiments, and its several details are capable of modifications in various obvious respects, all without departing from the disclosure as defined in the appended claims.

For example, the present concepts may be combined with a canard design or rear pusher propeller wherein the propeller protector structure protects the propeller from impact forces arising from contact between the flying airplane and external persons or objects. The propeller protector concepts disclosed herein may also be extended to multi-engine airplanes or LTAs. In such designs, the propeller protector struts may converge on a longitudinal or chordal engine support member or on a spar, and may terminate thereupon. Another strut may then be provided to link each of the left and right spar or engine support member to a central backbone of the plane or LTA. Alternatively, the propeller protector in such instance could be connected directly to a main longitudinal member behind the wing including, but not limited to, a connection to the tail assembly or at point(s) between the tail assembly and wing. Further, the propeller protector in accord with the present concepts may alternatively comprise members providing substantially tensile, rather than substantially compressive, resistance to deformation.

What is claimed is:

1. An airplane flying toy comprising:

a longitudinal frame bearing a wing and a stabilizer;

a propeller rotatably disposed at a front end of the frame;

a force generating device attached to the longitudinal frame and adapted to impart a rotary motion to the propeller by a rotatable shaft; and a propeller protector comprising a substantially continuous frame disposed around and forward of the propeller, the propeller protector being connected by struts to the longitudinal frame;

wherein at least one of the propeller protector struts connects to the longitudinal frame at a position behind the wing.

2. An airplane flying toy in accord with claim 1, wherein the propeller protector comprises a carbon rod bent into a curvilinear shape and a connecting member connecting the ends of the carbon rod.

3. An airplane flying toy in accord with claim 2, wherein the longitudinal frame and struts comprise carbon rods.

4. An airplane flying toy in accord with claim 3, further comprising:

a battery comprising at least one of a NiMH and a LiPo cell, wherein the force generating device is a coreless DC motor having an output shaft connected to a gear in a reduction gear set and the propeller is connected by a shaft to the other gear in the reduction gear set, and wherein at least one of the wing and the stabilizer comprises a foam structure having a skin attached thereto.

5. An airplane flying toy in accord with claim 4, wherein the propeller protector comprises at least one cross-member spanning a distance between a first point on the propeller protector and a second point on the propeller protector.

6. An airplane flying toy in accord with claim 4, further comprising:

a receiver, wherein the receiver is configured to control, in combination with power provided from the battery, at least one of a throttle adjustment device and an actuator provided to move at least one of a rudder, elevator, flap, aileron, spoilers, and slat from a first position to a second position.

7. An airplane flying toy in accord with claim 4, further comprising:

a receiver, wherein the receiver is configured to control, in combination with power provided from the battery, at least one of a throttle adjustment device and an actuator provided to move at least one of a rudder, elevator, flap, aileron, spoilers, and slat from a first position to a second position.

8. An airplane flying toy in accord with claim 3, wherein the battery is a 145 milliamp LiPo cell, wherein the motor is a coreless DC motor having an output shaft connected to a gear in a reduction gear set and the propeller is connected by a shaft to the other gear in the reduction gear set, and wherein the wing comprises an EPS foam structure having a mylar skin with a thickness less than about 6 microns attached thereto.

9. An airplane flying toy in accord with claim 8, wherein the wingspan of the wing is about 16 inches, and wherein a combined weight of all parts of the airplane flying toy is less than about 16.5 grams.

10. An airplane flying toy in accord with claim 9, wherein the airplane flying toy is configured to fly at a speed of less than about 1.5 m/s.

11. An airplane flying toy comprising:

a longitudinal frame bearing a wing and a stabilizer;

a propeller rotatably disposed at a front end of the frame;

a force generating device attached to the longitudinal frame and adapted to impart a rotary motion to the propeller by a rotatable shaft;

a propeller protector extending at least partially around and longitudinally beyond the propeller, the propeller protector being connected by struts to the longitudinal frame and comprising at least one filament; and a battery comprising at least one of a NiMH and a LiPo cell;

wherein the force generating device is a coreless DC motor having an output shaft connected to a gear in a reduction gear set and the propeller is connected by a shaft to the other gear in the reduction gear set, and wherein at least one of the wing and the stabilizer comprises a foam structure having a skin attached thereto.

12. An airplane flying toy in. accord with claim 11, wherein the battery is a 145 milliamp LiPo cell, wherein the motor is a coreless DC motor having an output shaft connected to a gear in a reduction gear set and the propeller is connected by a shaft to the other gear in the reduction gear set, and wherein the wing comprises an EPS foam structure having a skin with a thickness less than about 6 microns attached thereto.

13. An airplane flying toy in accord with claim 12, wherein the wingspan of the wing is about 16 inches, and wherein a combined weight of all parts of the airplane flying toy is less than about 17.0 grams.

14. An airplane flying toy in accord with claim 13, wherein the airplane flying toy is configured to fly at a speed of less than about 1.5 m/s.

15. An ultra-light slow flying toy airplane comprising:

a frame; and a battery-powered motor attached to the frame, the motor configured to rotate a propeller;

wherein the frame comprises a main longitudinal element comprising a longitudinal rod, a wing support structure, and a propeller protector structure, wherein the wing support structure comprises a vertical wing fore strut, a horizontal wing fore strut, a plurality of wing rear struts, and a plurality of chordal struts collectively securing a wing to the main longitudinal element, wherein the propeller protector structure comprises at least one rod disposed to extend at least partially around and longitudinally beyond the propeller, and wherein the propeller protector is connected to at least one of the wing support structure and the main longitudinal element by a plurality of struts.

16. An ultra-light slow flying toy airplane according to claim 15, wherein at least one of the main longitudinal element, wing support structure elements, and propeller protector structure rod is a carbon rod.

17. An ultra-light slow flying toy airplane according to claim 16, wherein the battery-powered motor is a coreless DC motor, and wherein the wing comprises an EPS foam structure having a skin with a thickness less than about 6 microns attached thereto.

18. A propeller and propeller protector combination for flying toys, comprising:

a propeller configured to rotate about a center axis;

a frame disposed forward of and around the propeller;

a plurality of struts connected, at a first end, to the frame and disposed to extend away from the frame in a direction toward and around the propeller and to connect, at a second end, to a frame member behind the propeller, wherein a distance between the connection between the plurality of struts and the frame member and the center axis is less than a corresponding distance between the frame and the center axis where the center axis intersects a plane containing the frame.

* * * * *